US005376160A

United States Patent [19]

Neuer et al.

[11] Patent Number: 5,376,160

[45] Date of Patent: Dec. 27, 1994

[54] AGENT FOR THE TREATMENT OF METAL MELTS

[75] Inventors: Bernd Neuer, Schnaitsee, Germany; Dominique Riche, Tilloy-Lez-Cambrai; Franck B. Villette, Aulnoye Aymeries, both of France

[73] Assignees: SKW Trostberg Aktiengesellschaft, Trostberg, Germany; Affival S.A., Solesmes, France

[21] Appl. No.: 144,683

[22] Filed: Oct. 28, 1993

[30] Foreign Application Priority Data

Oct. 30, 1992 [DE] Germany ..... 4236727

[51] Int. Cl.[5] ..... C21C 7/00; B22F 1/00

[52] U.S. Cl. ..... 75/304; 75/321

[58] Field of Search ..... 75/321, 304–309

[56] References Cited

U.S. PATENT DOCUMENTS

| | | | |
|---|---|---|---|
| 4,078,915 | 3/1978 | Meichsner et al. | 75/58 |
| 4,108,637 | 8/1978 | Hetke | 75/304 |
| 4,159,906 | 7/1979 | Meichsner et al. | 75/58 |
| 4,832,742 | 5/1989 | Ototani | 75/304 |
| 5,264,023 | 11/1993 | Missol | 75/304 |

*Primary Examiner*—Peter D. Rosenberg
*Attorney, Agent, or Firm*—Felfe & Lynch

[57] ABSTRACT

The invention concerns an agent for treating metal melts in the form of a cored wire comprising a metallic sheath of steel or iron and a filling which contains a compound that splits off gas at the temperature of the metal melt and is based on an organic polymer in amounts of 0.2 to 20 g per meter cored wire. The invention also concerns the use of the agent for homogenizing, refining and homogeneously cooling as well as alloying metal melts.

7 Claims, No Drawings

AGENT FOR THE TREATMENT OF METAL MELTS

FIELD OF THE INVENTION

The invention concerns an agent for the treatment of metal melts in the form of a cored wire sheathed with metal.

BACKGROUND OF THE INVENTION

An object of metallurgical processes is to set a homogeneous analysis and temperature of the metal melt in the casting ladle. The convective currents in the ladle due to differences in density proceed too slowly and in practical operation have to be accelerated by introduction of inert flushing gases. An improved intermixing is often carried out by blowing in argon or nitrogen through porous bed stones or via lances.

Even in the well-known pneumatic lance-injection process e.g. for desulphurization of pig iron, the carrier gas not only provides the pneumatic transport of the fine-grained solids but at the same time also results in a homogeneous dispersion of the additives in the melt.

The development of the cored wire technique in secondary metallurgy has replaced pneumatic injection in some areas. The absence of a gas which generates turbulence is a disadvantage for many applications in particular for the injection of materials which do not develop their own vapor pressure. The homogenization of the melt occurs too slowly. Concentration peaks occur in the vicinity of the wire as it dissolves which lead to undesired reaction products or even to reductions in yield.

In German Offenlegungsschrift No. 41 03 197 A1 a process is described for the rapid cooling of a metallurgical melt with a wire which is suitable for this that is composed of a metal sheath made of a low-carbon steel sheet for example and a filling made of a granulate in which the melt, wire sheath and wire filling are comprised of essentially the same material. Although the introduction of this wire onto the bottom of the ladle causes a rapid release of the granulate particles in the lower region of the melt, however, the small particle size of 0.2 to 0.5 mm results in a rapid melting of the granulate particles and thus the main cooling effect is restricted to the vicinity of the ladle bottom. The cooled parts of the melt are only more or less homogeneously dispersed by the normal movement of the bath.

In this process the dispersion of the components of the wire filling in the melt thus depend exclusively on the thermal movement of the bath or on the vapor pressure of the filling materials of the wire. Since in leads to materials being introduced into the melt the cored wire injection which have a low or no vapor pressure, an additional dispersing effect by gas generation does not take place when porous gas purge stones are not present which is a disadvantage for a number of practical applications.

Addition of substances to metal melts that split off gas is also known. Of the known gas releasers that are possible for this purpose, limestone and flame coal lead to detrimental changes in the quality of the melts. Limestone thermally splits off carbon dioxide and due to these oxidizing conditions influences for example the steel analysis by burning of aluminum; also reactions with other additives cannot be ruled out. Flame coal also alters the steel analysis by carburizing processes; natural flame coal in addition always contains undesired amounts of oxygen.

The use of polyethylene as a solid compound which splits off ethene is already described in German Patent 22 52 796. However, it is there used as one of several components of a desulfurization composition for raw iron and ferro-alloy melts, which is introduced into the melt bath with the aid of the above mentioned lance process by means of a carrier gas stream. The main object of the polyethylene in this case is the creation of reducing conditions in the iron melt.

OBJECT OF THE INVENTION

The object of the invention is to create an agent of the above-mentioned type with a wire filling whose special admixtures split off gas at the application temperatures and thus cause the formation of turbulence in the metal bath which leads to a homogenization of the melt without having a detrimental effect on the composition of the melt.

DESCRIPTION OF THE INVENTION

This object is achieved according to the present invention by providing a wire filling which contains a compound that splits off gas based on an organic polymer in amounts of 0.2 to 20 g per meter filler wire.

The agent according to the present invention preferably contains polyethylene, polypropylene or/and polystyrene as the organic polymers. The organic polymer is preferably present in a granular form. The particle size is 0.1 to 10 mm, particularly preferably $<2.0$ mm and is enclosed by the cored wire sheath. The wire sheath is comprised of a metallic coating of steel or iron. In addition to the gas-releasing compound, the wire filling preferably also contains non-decomposable inorganic materials which are introduced as oxides of alkaline-earth metals or/and aluminum, oxides or/and nitrides of silicon or as metals or metal oxides of group VIII of the periodic system of the elements. Quicklime, magnesium oxide and lime aluminates are particularly preferred additives.

A preferred embodiment of the agent according to the present invention is a cored wire for iron and steel melts comprising an iron sheath which encloses a filling of 0.1 to 10% by weight polyethylene and 90 to 99.9% by weight filler material such as e.g. iron powder.

The use according to the present invention of one of the aforementioned organic polymers already provides the necessary amount of gas when added in amounts of only 1 to 2% by weight to the wire filling material. A larger or smaller addition of polymers in the cored wire depends on the geometry of the available ladles or the type of use of the cored wire. The amounts of carbon and hydrogen introduced by the thermal decomposition of the organic polymers are uncritical in the form according to the present invention since the metal melt analysis is not negatively changed by them. The amounts of released gas increase the turbulence flow of the metal melt and have a favorable effect on the bath movement. Primary or secondary reactions with the other filler additives can be ruled out.

The agent according to the present invention is primarily used for homogenizing, refining and short-term cooling of metal melts. Melts of iron and steel come into consideration as the metal melts.

The agent according to the present invention is also suitable for alloying metal melts by introducing microalloying elements such as titanium, molybdenum, boron and others. For this type of application, these elements, or compounds which release these elements under the melting conditions, are provided in the wire filling.

The cored wire according to the present invention generally has a diameter of about 5 to 16 mm, preferably of 9 to 13 mm. The wall thickness is between 0.1 and 0.8 mm, preferably 0.4 to 0.6 mm. The corresponding core diameter is 4.8 to 15.8 mm, preferably 8.2 to 11.8 mm.

The cored wire can be manufactured according to known methods such as those described for example in German Patent 41 03 197, column 3, lines 49–58 and 64–68 as well as in FIGS. 2 and 3.

In experiments with the agent according to the present invention it surprisingly turned out that the application of organic polymers in cored wires can be very versatile. The following examples are intended to further elucidate this.

EXAMPLE 1

Flushing a Ladle

In cases of impeded gas escape due to the flushing stones shifting on the base of the ladle, the application can for example be comprised of a simple stirring; the introduction of the agent according to the present invention in the form of a wire prevents a qualitative degradation of the affected batches.

Cored wire with iron as a coating material, diameter 13 mm, wall thickness 0.4 mm, core diameter 12.2 mm, with 4 g polyethylene (PE) per meter and a particle size between 0.5 and 1.0 mm (remaining filler core: inert material quicklime) was injected at a rate of 200 meters per minute. Since 1 g polyethylene splits off 0.86 N1 ethene, 688 N1 gas per minute are released in this process which corresponds to the output of the argon bed flushing stones. The flushing time for an 80 ton ladle is 3 minutes, afterwards the melt is homogeneous.

EXAMPLE 2

Refining of Steel Melts

A cored wire containing a filling mixture of calcium-aluminate refining slag and 3% PE is injected into a melt of high-carbon tool steel in a ladle. The slag particles in the lower ladle region are dispersed uniformly in the melt by strong turbulence. As a result the ascending liquid particles wash out finely suspended non-metallic inclusions (aluminum oxide) which collect in the slag. The degree of purity can be improved reproducibly from the initial value of Ko 60 to Ko$<$10 according to the steel-iron test paper.

EXAMPLE 3

When steel is continuously cast it is often necessary to cool the melts that are too hot within a short time to the target temperature for casting.

In order to cool homogeneously, the agent according to the present invention in the form of an iron cored wire with PE additive is introduced into a steel melt.

In order to cool a 100 ton batch by 10° C. in a short time, cored wire with an iron powder filling (as cooling agent) and an additive of 1% by weight PE with a particle size of 1.5 mm is used. For 66=10° C. and 100 ton melt weight, 750 m Fe wire with a diameter of 13 mm, corresponding to 700 kg iron, is injected. This amount is introduced in 3 minutes. Afterwards the melt is cooled homogeneously by 10° C., and can be cast immediately.

Results analogous to the 3 examples were obtained by replacing polyethylene by a polypropylene additive (1.5-fold weight) or polystyrene additive (3.7-fold weight relative to polyethylene) which generate the same amount of gas.

We claim:

1. A composition for the treatment of a metal melt, said composition comprising a cored metallic wire, and 0.2 to 20 g per meter of cored wire of a core filling containing an organic polymer which releases a gas at the temperature of the metal melt.

2. A composition of claim 1, wherein said organic polymer is polyethylene, polypropylene or polystyrene.

3. A composition of claim 1, wherein said organic polymer is in granular form having a particle size of 0.1 to 10 mm.

4. A composition of claim 3, wherein said granular organic polymer has a particle size of less than 2.0 mm.

5. A composition of claim 1, wherein said core filling additionally comprises a non-decomposable inorganic material.

6. A composition of claim 5, wherein said non-decomposable inorganic material is selected from the group consisting of oxides of alkaline earth metals and aluminum, oxides or nitrides of silicon, and metals or metal oxides of Group VIII of the periodic system of elements.

7. A composition of claim 1, wherein said sheath is an iron sheath, and the core filling contains 0.1 to 10% by weight of polyethylene and 90 to 99.9% by weight of iron powder.

* * * * *